US010941717B2

(12) United States Patent
Wanibe

(10) Patent No.: US 10,941,717 B2
(45) Date of Patent: Mar. 9, 2021

(54) THROTTLE CONTROLLER AND THROTTLE CONTROLLING METHOD

(71) Applicant: TOYOTA JIDOSHA KABUSHIKI KAISHA, Toyota (JP)

(72) Inventor: Masahiro Wanibe, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/658,284

(22) Filed: Oct. 21, 2019

(65) Prior Publication Data

US 2020/0132002 A1 Apr. 30, 2020

(30) Foreign Application Priority Data

Oct. 24, 2018 (JP) ..... JP2018-199837

(51) Int. Cl.
*F02D 41/00* (2006.01)
*F02D 9/02* (2006.01)

(52) U.S. Cl.
CPC ..... *F02D 41/0002* (2013.01); *F02D 9/02* (2013.01); *F02D 2009/022* (2013.01); *F02D 2200/0404* (2013.01); *F02D 2200/0406* (2013.01)

(58) Field of Classification Search
CPC ..... F02D 41/0002; F02D 9/02; F02D 2200/0404; F02D 2009/022; F02D 11/105
See application file for complete search history.

(56) References Cited

U.S. PATENT DOCUMENTS

2006/0081216 A1 4/2006 Muto et al.
2007/0203588 A1* 8/2007 Kraemer ..... G05B 17/02 700/29
2014/0326213 A1* 11/2014 Katsumata ..... F02D 23/02 123/399
2017/0166179 A1* 6/2017 Fujita ..... B60T 17/02
2019/0285009 A1* 9/2019 Wanibe ..... F02D 41/0002
2020/0208584 A1* 7/2020 Maekawa ..... F02D 41/068

FOREIGN PATENT DOCUMENTS

JP 2006-118373 A 5/2006
JP 2016-217176 A 12/2016
JP 20190203439 A 11/2019

* cited by examiner

*Primary Examiner* — George C Jin
(74) *Attorney, Agent, or Firm* — Hunton Andrews Kurth LLP

(57) ABSTRACT

When a required pressure ratio RP* is less than or equal to a calculation switching pressure ratio RPwot, an engine control unit calculates, as a target opening degree TA*, a throttle opening degree TA at which a throttle upstream-downstream pressure ratio RP is the required pressure ratio RP*. When the required pressure ratio RP* exceeds the calculation switching pressure ratio RPwot, the engine control unit obtains a switching point opening degree TAwot, a switching point load factor KLwot and a maximum load factor KLmax, and calculates the target opening degree TA* as a value that has a linear relationship with the required load factor KL* between the switching point opening degree TAwot and the maximum opening degree TAmax.

6 Claims, 5 Drawing Sheets

THROTTLE CONTROLLER AND THROTTLE CONTROLLING METHOD

CROSS-REFERENCE TO RELATED APPLICATIONS

This application claims priority to Japanese Patent Application No. 2018-199837, filed Oct. 24, 2018, the entire disclosure of which is incorporated by reference herein for all purpose.

BACKGROUND

The present disclosure relates to a throttle controller that controls the opening degree of a throttle valve of an engine and a throttle controlling method.

In an engine such as a vehicle engine, the opening degree of the throttle valve (hereinafter, referred to as throttle opening degree) is controlled to regulate the amount of air flowing into the cylinder (hereinafter, referred to as cylinder inflow air amount) for each combustion. The opening degree of the throttle valve is controlled by obtaining a required throttle downstream pressure PM* from the accelerator pedal depression degree and determining a target opening degree TA* from the required throttle downstream pressure PM*. The required throttle downstream pressure PM* is a required value of the pressure of the intake air after passing through the throttle valve (hereinafter, referred to as throttle downstream pressure).

In a large opening degree region, in which the throttle opening degree is large, the sensitivity of the flow rate of the intake air that passes through the throttle valve to the throttle opening degree is low. Accordingly, the amount of change of the throttle opening degree required to change the cylinder inflow air amount increases. Thus, in the large opening degree region, "throttle hunting" may occur, in which the throttle opening degree is greatly and frequently changed.

Conventionally, Japanese Laid-Open Patent Publication No. 2006-118373 discloses a throttle controller that calculates a target opening degree TA* according to an expression (1) when the required throttle downstream pressure PM* is higher than or equal to a specified pressure P1. "TAwot" in the expression (1) represents the throttle opening degree required to set the throttle downstream pressure to the specified pressure P1. "ΔTC" in the expression (1) is a correction opening degree obtained from an expression (2). "CD" in the expression (2) is a coefficient that is determined according to the engine rotation speed NE. The value of CD is set such that the ratio of a change of the throttle downstream pressure to a change of the throttle opening degree becomes the lower limit in the range in which throttle hunting is suppressed.

$$TA^{*}TAwot+\Delta TC \quad (1)$$

$$\Delta TC=CD\times(PM^{*}-P1) \quad (2)$$

The above-described conventional throttle controller is able to suppress throttle hunting. However, the target opening degree TA* when the required throttle downstream pressure PM* is maximized is not the maximum opening degree of the throttle valve. Therefore, the engine torque cannot be increased to the maximum value that can be intrinsically achieved.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a first general aspect, a throttle controller is provided that controls an opening degree of a throttle valve installed in an intake passage of an engine. An opening degree of the throttle valve is defined as a throttle opening TA. A target value of the throttle opening degree TA is defined as a target opening degree TA*. A maximum value in a control range of the throttle opening degree TA is defined as a maximum opening degree TAmax. A required value of a load factor KL of the engine is defined as a required load factor KL*. A maximum value of the load factor KL in a current controlled state of the engine is defined as a maximum load factor KLmax. A ratio of an intake pressure after passing through the throttle valve to an intake pressure before passing through the throttle valve is defined as a throttle upstream-downstream pressure ratio RP. The throttle upstream-downstream pressure ratio RP required to cause the load factor KL to be the required load factor KL* is defined as a required pressure ratio RP*. The throttle opening degree TA when the throttle upstream-downstream pressure ratio RP is a specified value RPwot is defined as a switching point opening degree TAwot. The load factor KL when the throttle upstream-downstream pressure ratio RP is the specified value RPwot is defined as a switching point load factor KLwot. The throttle controller is configured to execute a target opening degree calculation process and a throttle actuation process. In the target opening degree calculation process, the throttle controller: calculates, as the target opening degree TA*, the throttle opening degree TA at which the throttle upstream-downstream pressure ratio RP is the required pressure ratio RP* in a case in which the value of the required pressure ratio RP* is less than or equal to the specified value RPwot; and calculates, as the target opening degree TA*, a value that satisfies a following expression in a case in which the value of the required pressure ratio RP* exceeds the specified value RPwot.

$$TA^{*}=TAwot+(TAmax-TAwot)\times\frac{KL^{*}-KLwot}{KLmax-KLwot}$$

In the throttle actuation process, the throttle controller actuates throttle valve to cause the throttle opening degree TA to be the target opening degree TA*.

In a second general aspect, a throttle controller is provided that controls an opening degree of a throttle valve installed in an intake passage of an engine. An opening degree of the throttle valve is defined as a throttle opening TA. A target value of the throttle opening degree TA is defined as a target opening degree TA*. A maximum value in a control range of the throttle opening degree TA is defined as a maximum opening degree TAmax. A required value of a load factor KL of the engine is defined as a required load factor KL*. A maximum value of the load factor KL in a current controlled state of the engine is defined as a maximum load factor KLmax. A ratio of an intake pressure after passing through the throttle valve to an intake pressure before passing through the throttle valve is defined as a throttle upstream-downstream pressure ratio RP. The throttle upstream-downstream pressure ratio RP required to cause the load factor KL to be the required load factor KL* is defined as a required pressure ratio RP*. The throttle opening degree TA when the throttle upstream-downstream pressure ratio RP is a specified value RPwot is defined as a switching point opening degree TAwot. The load factor KL when the throttle upstream-downstream pressure ratio RP is the specified value RPwot is defined as a switching point load factor KLwot. The throttle controller includes circuitry that is configured to execute a target opening degree calculation process and a throttle actuation process. In the target opening degree calculation process, the throttle controller: calculates, as the target opening degree TA*, the throttle opening degree TA at which the throttle upstream-downstream pressure ratio RP is the required pressure ratio RP* in a case in which the value of the required pressure ratio RP* is less than or equal to the specified value RPwot; and calculates, as the target opening degree TA*, a value that satisfies a following expression in a case in which the value of the required pressure ratio RP* exceeds the specified value RPwot.

$$TA^* = TAwot + (TAmax - TAwot) \times \frac{KL^* - KLwot}{KLmax - KLwot}$$

In the throttle actuation process, the throttle controller actuates throttle valve to cause the throttle opening degree TA to be the target opening degree TA*.

In a third general aspect, a throttle controlling method for controlling an opening degree of a throttle valve installed in an intake passage of an engine is provided. An opening degree of the throttle valve is defined as a throttle opening TA. A target value of the throttle opening degree TA is defined as a target opening degree TA*. A maximum value in a control range of the throttle opening degree TA is defined as a maximum opening degree TAmax. A required value of a load factor KL of the engine is defined as a required load factor KL*. A maximum value of the load factor KL in a current controlled state of the engine is defined as a maximum load factor KLmax. A ratio of an intake pressure after passing through the throttle valve to an intake pressure before passing through the throttle valve is defined as a throttle upstream-downstream pressure ratio RP. The throttle upstream-downstream pressure ratio RP required to cause the load factor KL to be the required load factor KL* is defined as a required pressure ratio RP*. The throttle opening degree TA when the throttle upstream-downstream pressure ratio RP is a specified value RPwot is defined as a switching point opening degree TAwot. The load factor KL when the throttle upstream-downstream pressure ratio RP is the specified value RPwot is defined as a switching point load factor KLwot. The throttle controlling method includes:

calculating, as the target opening degree TA*, the throttle opening degree TA at which the throttle upstream-downstream pressure ratio RP is the required pressure ratio RP* in a case in which the value of the required pressure ratio RP* is less than or equal to the specified value RPwot;

calculating, as the target opening degree TA*, a value that satisfies a following expression in a case in which the value of the required pressure ratio RP* exceeds the specified value RPwot; and $$TA^* = TAwot + (TAmax - TAwot) \times \frac{KL^* - KLwot}{KLmax - KLwot}$$

actuating throttle valve to cause the throttle opening degree TA to be the target opening degree TA*.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A throttle controller according to an embodiment will be described with reference to FIGS. 1 to 9. An engine controller of the present embodiment is employed for a naturally aspirated engine mounted on a vehicle.

Figure 1:
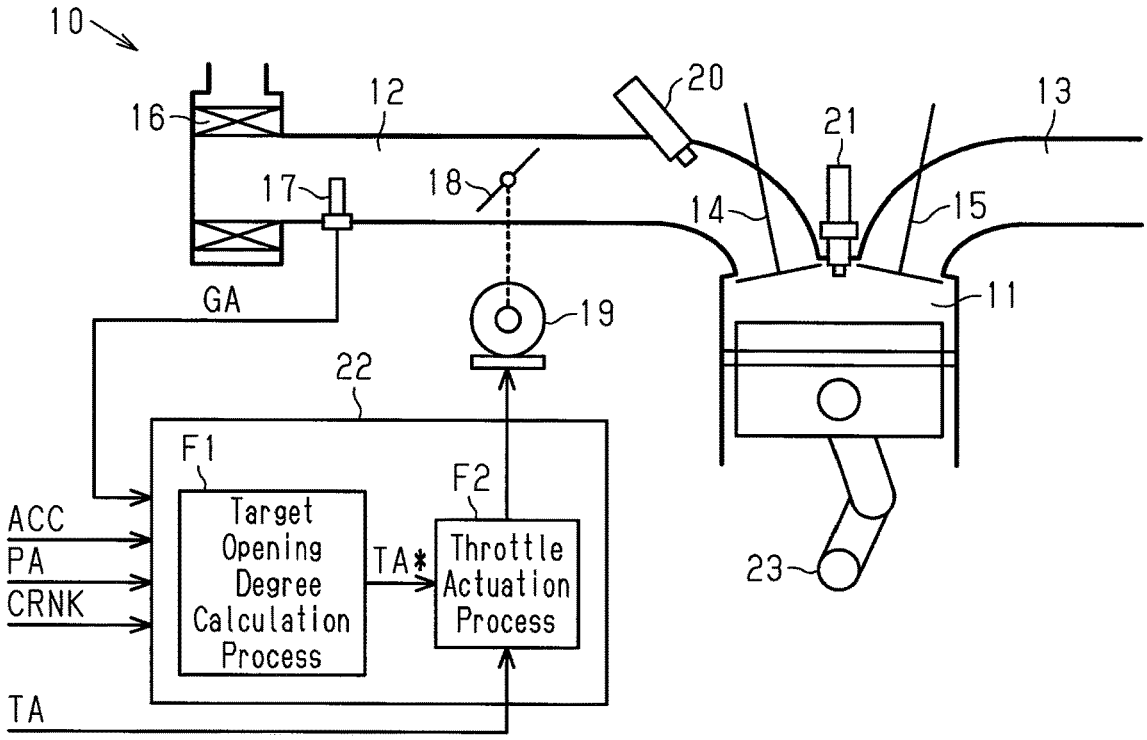
FIG. 1 is a schematic diagram showing the configuration of an engine controller according to an embodiment.

As shown in FIG. 1, an engine 10 to which the present embodiment is applied includes an intake passage 12, through which intake air flowing into a combustion chamber 11 flows, and an exhaust passage 13, through which exhaust gas discharged from the combustion chamber 11 flows. The engine 10 also includes an intake valve 14 and an exhaust valve 15. The intake valve 14 is selectively opened and closed to connect and disconnect the intake passage 12 to and from the combustion chamber 11. The exhaust valve 15 is selectively opened and closed to connect and disconnect the exhaust passage 13 to and from the combustion chamber 11.

The intake passage 12 is provided with an air cleaner 16, which filters out dust and the like in the intake air, and an air flowmeter 17, which detects the flow rate of intake air (intake flow rate GA) flowing through the intake passage 12. A throttle valve 18 is installed on the downstream side of the air flowmeter 17 in the intake passage 12. The throttle valve 18 is installed in the intake passage 12 while being rotationally supported. The throttle valve 18 is rotated by a throttle motor 19. Further, an injector 20, which injects fuel into the intake air, is installed on the downstream side of the throttle valve 18 in the intake passage 12. An ignition plug 21 is installed in the combustion chamber 11. The ignition plug 21 ignites mixture of intake air that has been introduced through the intake passage 12 and fuel injected by the injector 20.

The throttle valve 18 is a valve that adjusts the flow rate of the intake air (intake flow rate) passing through the throttle valve 18 by changing the opening area in accordance with the rotational position in the intake passage 12. In the following description, a throttle opening degree TA represents the rotation angle of the throttle valve 18 from the rotational position where the opening area is zero (fully closed position).

The engine 10 configured as described above is controlled by an engine control unit 22. The engine control unit 22 has an arithmetic processing circuit, which executes various types of calculating process related to engine control, and a memory storing programs and data. In addition to the detection signal of the intake flow rate GA from the air flowmeter 17, the engine control unit 22 receives detection signals such as the depression amount of the accelerator pedal by the driver (accelerator pedal depression degree ACC) and the opening degree of the throttle valve 18 (throttle opening degree TA). The engine control unit 22 also receives a pulsed crank signal CRNK output in response to rotation of the crankshaft 23. The engine control unit 22 obtains the engine rotation speed NE from the crank signal CRNK.

The engine control unit 22 executes opening degree control of the throttle valve 18 as part of the engine control. In the opening degree control of the throttle valve 18, the engine control unit 22 calculates a target opening degree TA*, which is a target value of the throttle opening degree TA, in a target opening degree calculation process F1. The engine control unit 22 then executes actuation control of the throttle valve 18 in a throttle actuation process F2 in order to cause the throttle opening degree TA to be the target opening degree TA*. The actuation control of the throttle valve 18 is executed by adjusting the drive current to the throttle motor 19 through feedback control in accordance with the deviation of the throttle opening degree TA from the target opening degree TA*. In the present embodiment, the engine control unit 22 executing the opening degree control of the throttle valve 18 corresponds to the throttle controller.

In the calculation of the target opening degree TA* in the target opening degree calculation process F1, the engine control unit 22 first calculates a required load factor KL*, which is a required value of the load factor KL, based on the accelerator pedal depression degree ACC and the engine rotation speed NE. The load factor KL indicates the ratio of the mass of intake air flowing into the combustion chamber 11 (cylinder inflow air amount) to the mass of intake air in the standard atmospheric condition (the standard atmospheric pressure: 1013 hPa, the standard temperature: 20°, the standard relative humidity: 60%) occupying the piston displacement of the cylinder. That is, the load factor KL represents the charging efficiency $\eta c$ of the intake air of the combustion chamber 11.

The cylinder inflow air amount is determined by the engine rotation speed NE and the intake pressure in a section of the intake passage 12 on the downstream side of the throttle valve 18 (hereinafter, referred to as a throttle downstream pressure PM). Therefore, the throttle downstream pressure PM that is required to obtain the load factor KL corresponding to the required load factor KL* can be obtained based on the required load factor KL* and the engine rotation speed NE. Based on the required load factor KL* and the engine rotation speed NE, the engine control unit 22 calculates, as the value of a required throttle downstream pressure PM*, the throttle downstream pressure PM at which the load factor KL corresponding to the required load factor KL* is obtained.

The mass flow rate of the intake air that passes through the throttle valve 18 and is distributed to the combustion chamber 11 of each cylinder is defined as an intake valve passing flow rate. The intake air flows into the combustion chamber 11 intermittently in response to opening and closing of the intake valve 14. Therefore, the actual intake valve passing flow rate fluctuates in accordance with rotation of the engine 10. In the following description, however, a value obtained by averaging out the fluctuating portions of the actual intake valve passing flow rate is used as the valve passing flow rate. The number of intake strokes performed while the engine 10 makes one revolution is determined by the number of the cylinders of the engine 10. Therefore, the engine rotation speed NE, which is the number of revolutions of the engine 10 per unit time, is proportional to the number of intake strokes performed per unit time in the engine 10. Also, the product obtained by multiplying the engine rotation speed NE by the required load factor KL* (NE×KL*) is proportionate to the intake valve passing flow rate at which the load factor KL corresponding to the required load factor KL* is obtained.

In the present embodiment, [rpm·%] is used as the unit of the flow rate of intake air used in calculation of the target opening degree TA*. When this unit is used, the intake valve passing flow rate [rpm·%] agrees with the product obtained by multiplying the engine rotation speed NE [rpm] by the required load factor KL* [%].

The intake valve passing flow rate in a steady state in which the throttle opening degree TA and the engine rotation speed NE are maintained constant is equal to the flow rate of the intake air that passes through the throttle valve 18 (hereafter, referred to as a throttle passing flow rate). Thus, the load factor KL corresponding to the required load factor KL* is obtained if the target opening degree TA* of the throttle valve 18 is set to the throttle opening degree TA at which the throttle downstream pressure PM is the required throttle downstream pressure PM* and the throttle passing flow rate is the product obtained by multiplying the required load factor KL* by the engine rotation speed NE.

The throttle passing flow rate is the product of the velocity of the intake air passing through the throttle valve 18 and the opening area of the throttle valve 18. The opening area of the throttle valve 18 is a function of the throttle opening degree TA. Further, the velocity of the intake air passing through the throttle valve 18 is determined by the ratio of the throttle downstream pressure PM to the intake pressure on the upstream side of the throttle valve 18 in the intake passage 12 (throttle upstream pressure PAC). This ratio will hereafter be referred to as a throttle upstream-downstream pressure ratio RP. The throttle upstream-downstream pressure ratio RP is a value within the range from 0 to 1. Therefore, if two of the three values, which are the throttle opening degree TA, the throttle upstream-downstream pressure ratio RP, and the throttle passing flow rate, are determined, the remaining one value is determined naturally.

Figure 2:
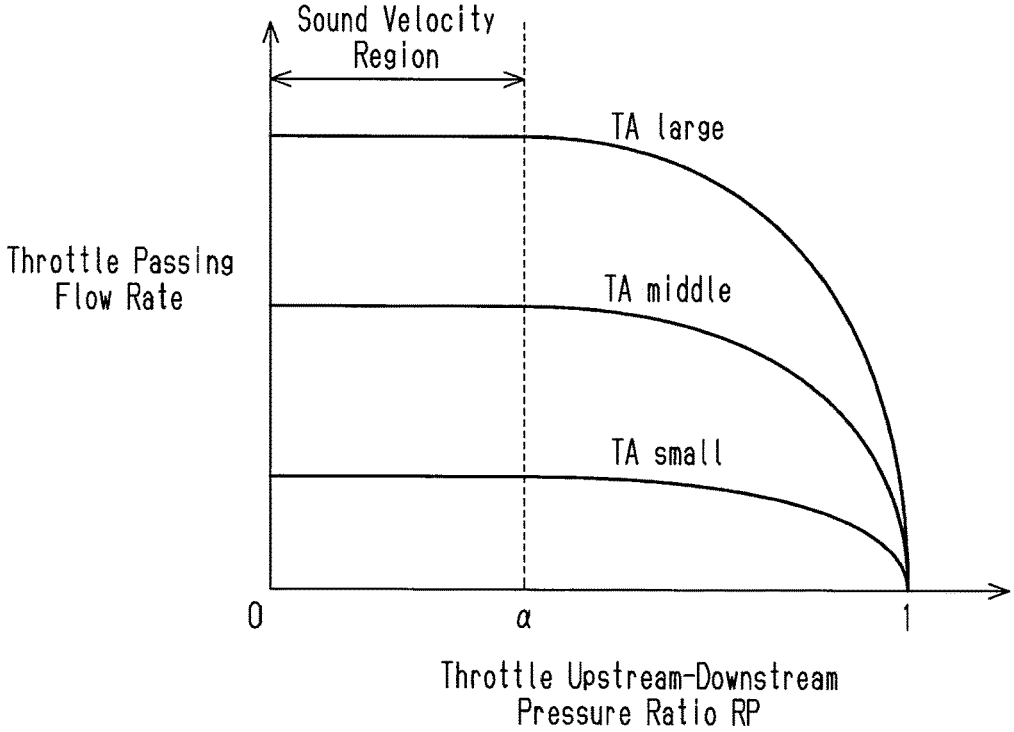
FIG. 2 is a graph showing the relationship between a throttle upstream-downstream pressure ratio, a throttle opening degree, and a throttle-passing flow rate.

FIG. 2 shows the relationship of the throttle passing flow rate with the throttle opening degree TA and the throttle upstream-downstream pressure ratio RP. The velocity of the intake air passing through the throttle valve 18 is 0 when the throttle upstream-downstream pressure ratio RP is 1, and is the sound velocity when the throttle upstream-downstream pressure ratio RP is equal to or less than a fixed value α. When the throttle upstream-downstream pressure ratio RP is gradually increased to 1 from α, the velocity of the intake air passing through the throttle valve 18 is gradually decreased to 0, which is the value when the throttle upstream-downstream pressure ratio RP is 1, from the sound velocity, which is the value when the throttle upstream-downstream pressure RP ratio is α. The throttle passing flow rate is the product of the velocity of the intake air passing through the throttle valve 18 and the opening area of the throttle valve 18. Thus, in a state in which the throttle upstream-downstream pressure ratio RP is constant, the throttle passing flow rate increases as the throttle opening degree TA increases. Therefore, the change tendency of the throttle passing flow rate with respect to the throttle opening degree TA and the throttle upstream-downstream pressure ratio RP is as shown in FIG. 2.

The throttle passing flow rate in the region where the throttle upstream-downstream pressure ratio RP is less than or equal to a (sound velocity region) is defined as a saturation flow rate. The saturation flow rate is the product of the opening area of the throttle valve 18 and the sound velocity. The value of the saturation flow rate is thus a function of the throttle opening degree TA. The ratio of the throttle passing flow rate to the saturation flow rate is defined as a Φ value. The velocity of the intake air passing through the throttle valve 18 is determined by the throttle upstream-downstream pressure ratio RP. Therefore, the Φ value is a function of the throttle upstream-downstream pressure ratio RP. The Φ value also indicates the ratio of the velocity of the intake air passing through the throttle valve 18 to the sound velocity.

Figure 3:
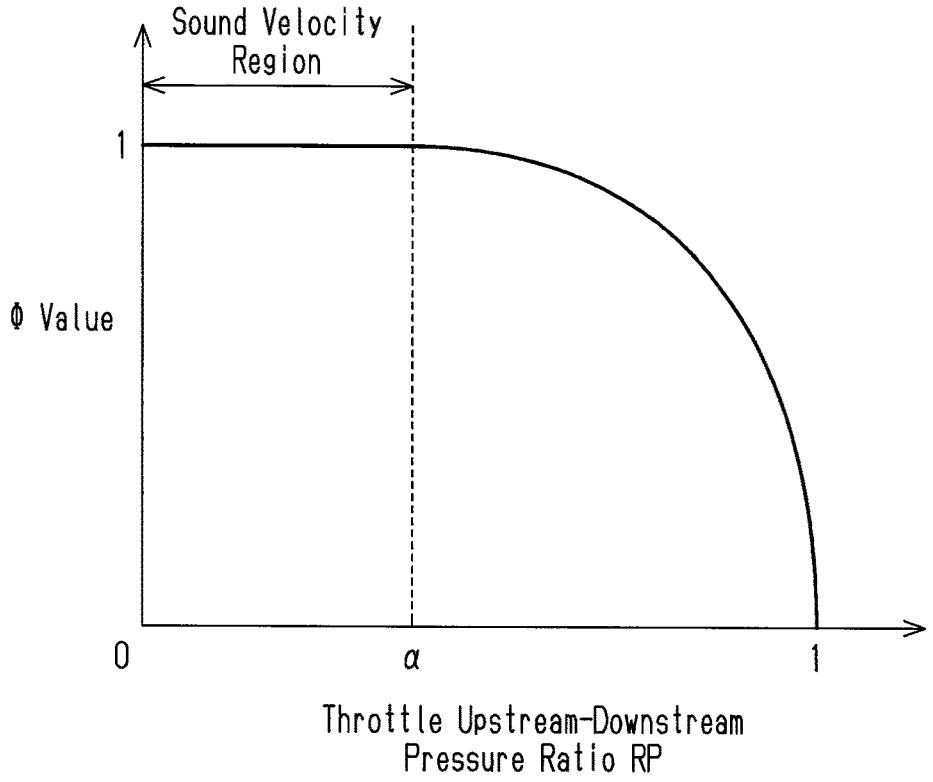
FIG. 3 is a graph showing the relationship between the throttle upstream-downstream pressure ratio and a 0 value.

FIG. 3 shows the relationship between the Φ value and the throttle upstream-downstream pressure ratio RP. As shown in FIG. 3, the Φ value in the sound velocity region, in which the throttle upstream-downstream pressure ratio RP is less than or equal to α, is 1. The Φ value when the throttle upstream-downstream pressure ratio RP is 1 is 0. When the throttle upstream-downstream pressure ratio RP is gradually increased from α to 1, the Φ value gradually decreases from 1, which is the value when the throttle upstream-downstream pressure ratio RP is α, to 0, which is the value when the throttle upstream-downstream pressure ratio RP is 1. The memory of the engine control unit 22 stores, as a Φ value calculation map MAP1, the relationship between the Φ value and the throttle upstream-downstream pressure ratio RP.

Figure 4:
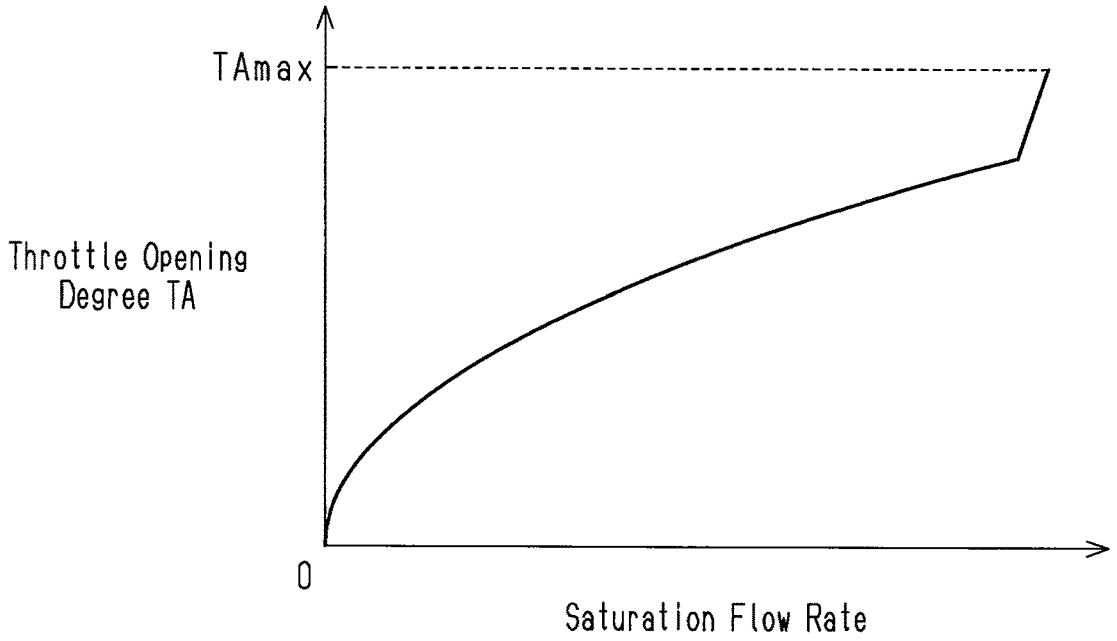
FIG. 4 is a graph showing the relationship between the throttle opening degree and the saturation flow rate.

FIG. 4 shows the relationship between the saturation flow rate and the throttle opening degree TA. As described above, the saturation flow is proportional to the opening area of the throttle valve 18. The relationship between the throttle opening degree TA and the opening area is determined by the dimensions and shapes of the intake passage 12 and the throttle valve 18. Accordingly, the relationship between the saturation flow rate and the throttle opening degree TA can be obtained from the design specifications of the intake passage 12 and the throttle valve 18. The memory of the engine control unit 22 stores, as an opening degree calculation map MAP2, the relationship between the saturation flow rate and the throttle opening degree TA.

The throttle passing flow rate can be obtained as a product obtained by multiplying the saturation flow rate at the current throttle opening degree TA by the Φ value at the current throttle upstream-downstream pressure ratio RP. The required throttle downstream pressure PM* is obtained as a value of the throttle downstream pressure PM at which the load factor KL corresponding to the required load factor KL* is obtained as described above. Therefore, if the current throttle upstream pressure PAC is known, it is possible to obtain a value of the throttle upstream-downstream pressure ratio RP at which the load factor KL corresponding to the required load factor KL* is obtained (hereinafter, referred to as a required pressure ratio RP*) as the ratio of the required throttle downstream pressure PM* to the throttle upstream pressure PAC. In the naturally aspirated engine 10, the throttle upstream pressure PAC can be regarded as the same pressure as the atmospheric pressure PA. In the present embodiment, the quotient (PM*/PA) obtained by dividing the required throttle downstream pressure PM* by the atmospheric pressure PA is obtained as the value of the required pressure ratio RP*.

Further, as described above, the intake valve passing flow rate at which the load factor KL corresponding to the required load factor KL* is obtained is the product obtained by multiplying the required load factor KL* by the engine rotation speed NE. Also, in a steady state, the intake valve passing flow rate is equal to the throttle passing flow rate. Therefore, the value of the target opening degree TA* necessary for achieving the load factor KL corresponding to the required load factor KL* can be calculated by the following procedure.

As described above, the required throttle downstream pressure PM* indicates the throttle downstream pressure PM when the intake valve passing flow rate is a flow rate at which the load factor KL corresponding to the required load factor KL* is obtained. Therefore, the value of the required pressure ratio RP*, which is the ratio of the required throttle downstream pressure PM* to the throttle upstream pressure PAC (the atmospheric pressure PA is used in the present embodiment), indicates the throttle upstream-downstream pressure ratio RP when the intake valve passing flow rate is the flow rate at which the load factor KL corresponding to the required load factor KL* is obtained. Thus, based on the relationship in FIG. 3, the Φ value when the throttle upstream-downstream pressure ratio RP is the required pressure ratio RP* is obtained. Then, the quotient obtained by dividing, by the obtained Φ value, the intake valve passing flow rate necessary for obtaining the load factor KL corresponding to the required load factor KL*. The value of this quotient represents the saturation flow rate at the throttle opening degree TA at which the load factor KL corresponding to the required load factor KL* is obtained, that is, the saturation flow rate at the target opening degree TA*. Therefore, if the throttle opening degree TA at which the value of the quotient is the saturation flow rate is obtained as the value of the target opening degree TA* based on the relationship in FIG. 4, it is possible to calculate the throttle opening degree TA at which the load factor KL corresponding to the required load factor KL* is obtained as the value of the target opening degree TA*.

However, when controlling the opening degree of the throttle valve 18 based on the target opening degree TA*, which is calculated in the above-described manner, the following problems may occur.

Figure 5:
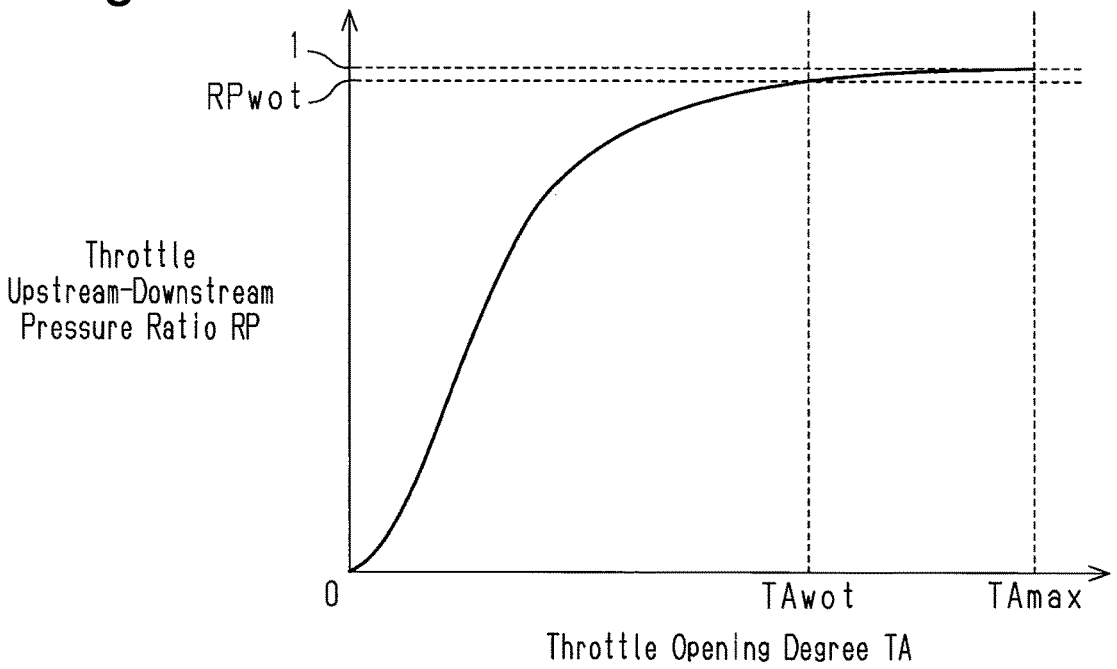
FIG. 5 is a graph showing the relationship between the throttle opening degree and the throttle upstream-downstream pressure ratio.

FIG. 5 shows changes in the throttle upstream-downstream pressure ratio RP when the throttle opening degree TA is changed in a condition in which the throttle upstream pressure PAC (in the present embodiment, the atmospheric pressure PA is used) and the engine rotation speed NE are constant. When the throttle opening degree TA is increased from 0 to the maximum opening degree TAmax, the throttle upstream-downstream pressure ratio RP is increased from 0, which is the value when the throttle opening degree TA is 0, to 1, which is the value when the throttle opening degree TA is the maximum opening degree TAmax. However, as the throttle opening degree TA approaches the maximum opening degree TAmax, the rate of change of the throttle upstream-downstream pressure ratio RP relative to the throttle opening degree TA (the ratio of the amount of change of the throttle upstream-downstream pressure ratio RP to the amount of change of throttle opening degree TA) gradually decreases. Therefore, in a large opening degree region, in which the throttle upstream-downstream pressure ratio RP is close to 1, the sensitivity of the throttle upstream-downstream pressure ratio RP to the throttle opening degree TA is low. That is, the value of the target opening degree TA* changes greatly in response to a slight change in the required load factor KL*. As a result, in the large opening degree region, "throttle hunting" may occur, in which the throttle opening degree TA is greatly and frequently changed. This may apply significant load on the throttle motor 19 and the like.

In the present embodiment, the target opening degree TA* of the throttle valve 18 is calculated in the manner described below in order to suppress such throttle hunting in the large opening degree region.

Figure 6:
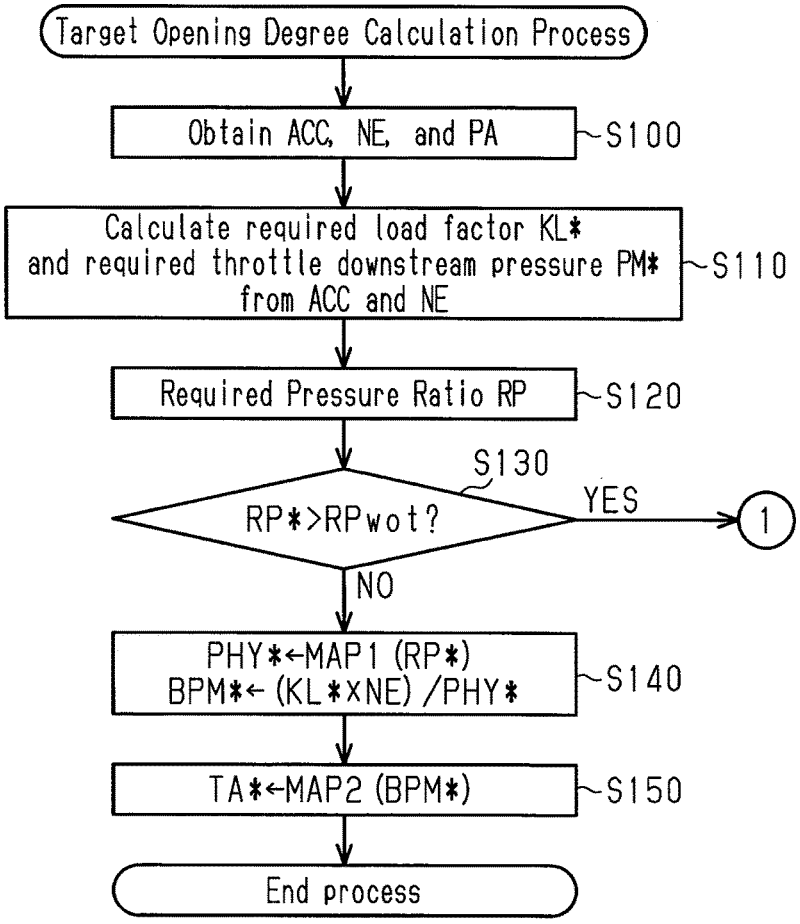
FIG. 6 is a flowchart showing a part of a procedure of a target opening degree calculation routine.
Figure 7:
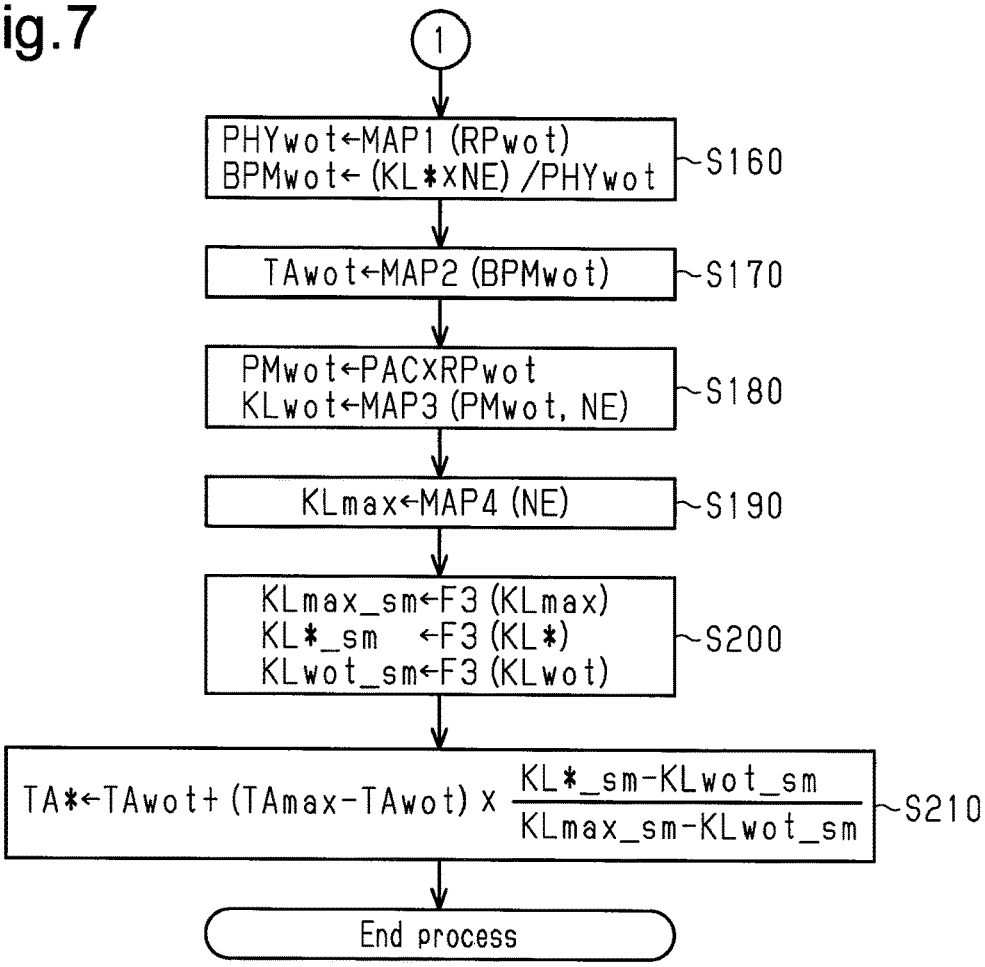
FIG. 7 is a flowchart showing the remainder of the procedure of the target opening degree calculation routine.

FIGS. 6 and 7 show a flowchart of a target opening degree calculation routine for calculating the target opening degree TA* in the target opening degree calculation process F1. The engine control unit 22 repeatedly executes the processes of this routine at each specified control cycle while the engine is running.

When this routine is started, first, values of the accelerator pedal depression degree ACC, the engine rotation speed NE, and the atmospheric pressure PA are obtained in step S100. Then, in step S110, the required load factor KL* and the required throttle downstream pressure PM* are calculated based on the accelerator pedal depression degree ACC and the engine rotation speed NE. Subsequently, in step S120, the quotient obtained by dividing the required throttle downstream pressure PM* by the throttle upstream pressure PAC (in the present embodiment, the atmospheric pressure PA is used) is obtained as the value of the required pressure ratio RP*. When applied to a forced-induction engine, a detected value or an estimated value of the boost pressure is preferably used as the value of the throttle upstream pressure PAC.

Subsequently, in step S130, it is determined whether the value of the required pressure ratio RP* is greater than a specified value (calculation switching pressure ratio RPwot). The value of the calculation switching pressure ratio RPwot is set to be less than the lower limit of the range of the throttle upstream-downstream pressure ratio RP in which throttle hunting may occur. When the value of the required pressure ratio RP* is less than or equal to the calculation switching pressure ratio RPwot (step 130: NO), the process moves to step S140. In contrast, when the value of the required pressure ratio RP* is greater than the calculation switching pressure ratio RPwot (YES), the process moves to step S160.

When the process moves to step S140, the Φ value when the throttle upstream-downstream pressure ratio RP is the required pressure ratio RP* is obtained as a required Φ value PHY* by using the Φ value calculation map MAP1. Further, in step S140, the quotient obtained by dividing the product of the required load factor KL* and the engine rotation speed NE by the required Φ value PHY* is calculated as the value of a required saturation flow rate BPM*. Subsequently, in step S150, the throttle opening degree TA at which the saturation flow rate is the required saturation flow rate BPM* is calculated as the value of the target opening degree TA* by using the opening degree calculation map MAP2. Thereafter, the process of the current routine is ended.

In contrast, if the process moves to step S160 as the result of the determination in step S130, the following two values are calculated in step S160. First, the Φ value when the throttle upstream-downstream pressure ratio RP is the calculation switching pressure ratio RPwot is calculated as a switching point Φ value PHYwot by using the Φ value calculation map MAP1. Also, the quotient obtained by dividing, by the switching point Φ value PHYwot, the product obtained by multiplying the required rotation factor KL* by the engine rotation speed NE is calculated as the value of a switching point saturation flow rate BPMwot.

Subsequently, in step S170, the throttle opening degree TA at which the saturation flow rate is the switching point saturation flow rate BPMwot is calculated as the value of the switching point opening degree TAwot by using the opening degree calculation map MAP2.

Further, in the subsequent step S180, the value of the load factor KL when the throttle upstream-downstream pressure ratio RP is the calculation switching pressure ratio RPwot is calculated as the value of a switching point load factor KLwot. In the calculation of the switching point load factor KLwot, first, the product obtained by multiplying the throttle upstream pressure pressure PAC (in the present embodiment, the atmospheric pressure PA is used) by the calculation switching pressure ratio RPwot is obtained as the value of a switching point throttle downstream pressure PMwot. On the other hand, the memory of the engine control unit 22 stores, as a load factor calculation map MAP3, the relationship of the load factor KL with the throttle downstream pressure PM and the engine rotation speed NE. The value of the switching point load factor KLwot is calculated by obtaining the load factor KL at which the throttle downstream pressure PM is the switching point throttle downstream pressure PMwot at the current engine rotation speed NE by using the load factor calculation map MAP3. The thus calculated value of the switching point load factor KLwot represents the load factor KL in a case in which the throttle opening degree TA is set to the switching point opening degree TAwot without changing the controlled state of the engine 10 except for the throttle opening degree TA.

In an engine equipped with a variable valve actuation mechanism, which varies the valve performances of the intake valve 14 and the exhaust valve 15 (the valve timing, the valve lift, and the like), the load factor KL is also changed by operating the variable valve actuation mechanism in addition to the throttle downstream pressure PM and the engine rotation speed NE. Thus, in the case of an engine equipped with a variable valve actuation mechanism, the load factor calculation map MAP3 is configured to store the relationship of the load factor KL with the throttle downstream pressure PM, the engine rotation speed NE, and the operated amount of the variable valve actuation mechanism. The switching point load factor KLwot is preferably calculated from the current engine rotation speed NE, the operated amount of the variable valve actuation mechanism, and the switching point throttle downstream pressure PMwot.

Figure 8:
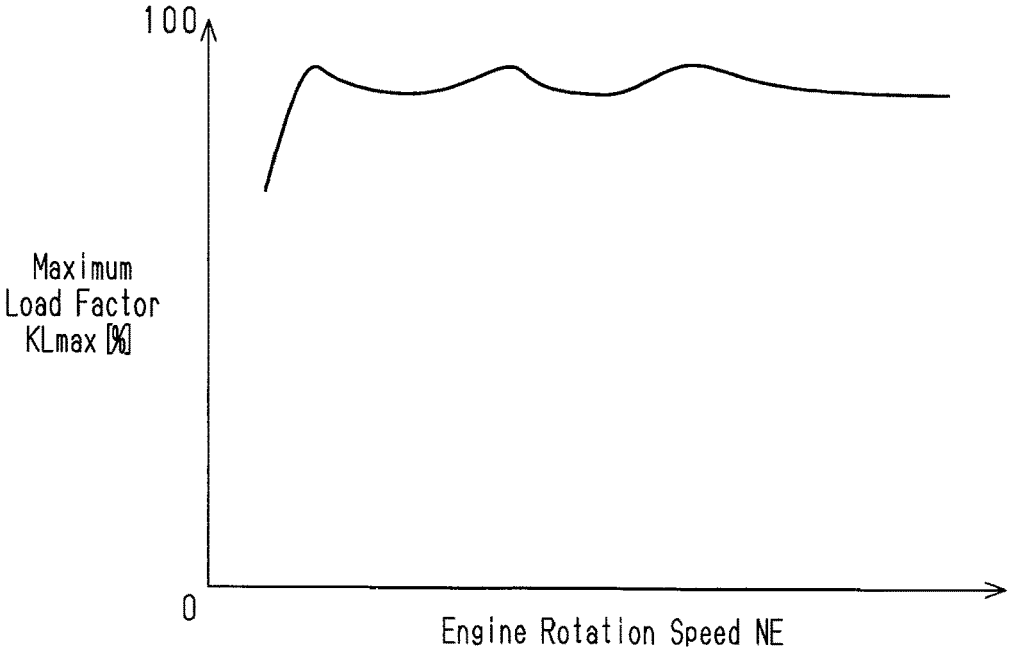
FIG. 8 is a graph showing the relationship between the engine rotation speed and the maximum load factor.

In the subsequent step S190, a maximum load factor KLmax, which is the maximum value of the load factor KL at the current engine rotation speed NE, is calculated. The calculation of the maximum load factor KLmax is executed using a maximum load factor calculation map MAP4 as shown in FIG. 8, which stores the relationship between the engine rotation speed NE and the maximum load factor KLmax in the engine 10. The thus calculated value of the maximum load factor KLmax represents the load factor KL in a case in which the throttle opening degree TA is set to the maximum opening degree TAmax without changing the controlled state of the engine 10 except for the throttle opening degree TA in the current operating state of the engine 10.

In the subsequent step S200, a smoothed value KLmax_sm of the maximum load factor KLmax, a smoothed value KL*_sm of the required load factor KL*, and a smoothed value KLwot_sm of the switching point load factor KLwot are calculated. The smoothed value KLmax_sm represents a value obtained by subjecting the maximum load factor KLmax to a filtering process F3 for smoothing values. Likewise, the smoothed value KL*_sm represents a value obtained by subjecting the required load factor KL* to the filtering process F3. The smoothed value KLwot_sm represents a value obtained by subjecting the switching point load factor KLwot to the filtering process F3.

A parameter that is subjected to the filtering process F3 is denoted as X, and a value (smoothed value) obtained by subjecting the parameter X to the filtering process F3 is denoted as Y. In the present embodiment, the filtering process F3 is executed on the parameter X by updating the value of the smoothed value Y such that it satisfies the expression (4). In the expression (4), S is a coefficient that determines the extent of smoothing of the smoothed value Y and is set to a value greater than 1. The extent of smoothing of the smoothed value Y is increased as the value to which the coefficient S is set is increased.

$$Y[\text{post-update}] = \frac{X + (S-1) \times Y[\text{pre-update}]}{S} \tag{4}$$

In step S210, a value that satisfies the relationship of the expression (5) is calculated as the target opening degree TA* based on the smoothed values KLmax_sm, KL*_sm, and KLwot_sm, which have been calculated in step S200. After the calculation, the process of the current routine is ended.

$$TA^* = TAwot + (TAmax - TAwot) \times \frac{\text{KL}^*\text{_sm} - \text{KLwot_sm}}{\text{KLmax_sm} - \text{KLwot_sm}} \tag{5}$$

Figure 9:
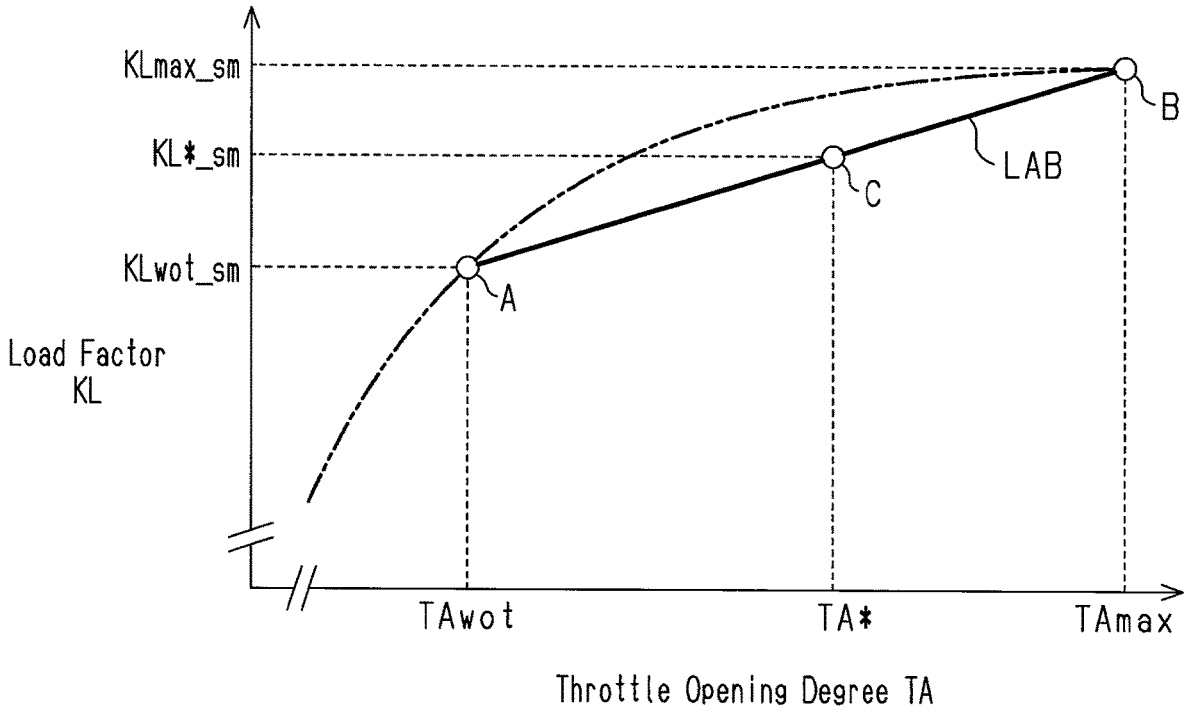
FIG. 9 is a graph showing a manner of calculation of the target opening degree in a large opening degree region in the target opening degree calculation routine.

The parameters in the expression (5) are plotted on the rectangular coordinate system of FIG. 9, in which the throttle opening degree TA and the load factor KL are represented as the axes. The line segment LAB in FIG. 9 connects a coordinate point A and a coordinate point B. The coordinate point A is a coordinate point at which the throttle opening degree TA is the switching point opening degree TAwot, and the load factor KL is the smoothed value KLwot_sm of the switching point load factor KLwot. The coordinate point B is a coordinate point at which the throttle opening degree TA is the maximum opening degree TAmax, and the load factor KL is the smoothed value KLmax_sm of the maximum load factor KLmax. In step S210, the value of the throttle opening degree TA at which the load factor KL is the smoothed value KL*_sm of the required load factor KL* on the line segment LAB is calculated as the target opening degree TA*. That is, the expression (5) is an expression for calculating the target opening degree TA* through linear interpolation between the coordinate points A and B.

An operation and advantages of the present embodiment will now be described.

The target opening degree calculation process F1 in the throttle controller of the present embodiment is executed to calculate, as the target opening degree TA*, the throttle opening degree TA necessary for achieving the load factor KL corresponding to the required load factor KL*, which has been obtained from the accelerator pedal depression degree ACC and the engine rotation speed NE. In the calculation of the target opening degree TA*, the throttle upstream-downstream pressure ratio RP at which the load factor KL corresponding to the required load factor KL* is obtained is calculated as the required pressure ratio RP*. When the required pressure ratio RP* is less than or equal to the specified value (the calculation switching pressure ratio RPwot), the throttle opening degree TA at which the throttle upstream-downstream pressure ratio RP is the required pressure ratio RP* is calculated as the target opening degree TA* based on the relationship between the throttle upstream-downstream pressure ratio RP and the throttle opening degree TA.

The long dashed double-short dashed line in FIG. 9 represents the relationship between the target opening degree TA* and the required load factor KL* in a case in which, even if the required pressure ratio RP* exceeds the calculation switching pressure ratio RPwot, the throttle opening degree TA at which the throttle upstream-downstream pressure ratio RP is the required pressure ratio RP* is calculated as the target opening degree TA*, as in the case in which the required pressure ratio RP* is less than or equal to the calculation switching pressure ratio RPwot. In this case, the sensitivity of the target opening degree TA* to the load factor KL increases as the target opening degree TA* approaches the maximum opening degree TAmax. Therefore, in the large opening degree region, the value of the target opening degree TA* changes greatly in response to a slight change in the required load factor KL*, which causes throttle hunting.

In the present embodiment, when the required pressure ratio RP* exceeds the calculation switching pressure ratio RPwot, the target opening degree TA* is calculated in the following manner. That is, in the calculation of target opening degree TA* in this case, the switching point opening degree TAwot is obtained, which is the throttle opening degree TA at which the throttle upstream-downstream pressure ratio RP is the calculation switching pressure RPwot. Also, the load factor KL at which the throttle opening degree TA is set to the switching point opening degree TAwot is obtained as the value of the switching point load factor KLwot, and the load factor KL at which the throttle opening degree TA is set to the maximum opening degree TAmax is obtained as the maximum load factor KLmax. In this case, in the large opening degree region, in which the throttle opening degree TA is greater than or equal to the switching point opening degree TAwot, the target opening degree TA* is calculated as a value that has a linear relationship with the required load factor KL* (the smoothed value KL*_sm, to be precise). As a result, the rate of change of the target opening degree TA* relative to the required load factor KL* in the large opening degree region (the smoothed value KL*_sm, to be precise) becomes constant. Accordingly, throttle hunting is unlikely to occur.

Also, in the present embodiment, the calculation of the target opening degree TA* through linear interpolation in accordance with the load factor KL in the large opening degree region as described above is executed using the smoothed values of the maximum load factor KLmax, the required load factor KL*, and the switching point load factor KLwot. Therefore, as compared to a case in which the maximum load factor KLmax, the required load factor KL*, and the switching point load factor KLwot are used to calculate the target opening degree TA* in the large opening degree region, changes in the target opening degree TA* due to changes in the accelerator pedal depression degree ACC or the engine rotation speed NE are gradual. This also suppresses throttle hunting.

Further, since the target opening degree TA* when the required load factor KL* (the smoothed value KL*_sm, to be precise) is the maximum load factor KLmax (the smoothed value KLmax_sm, to be precise) is the maximum opening degree TAmax, the engine torque can be increased to the maximum value that can be intrinsically achieved. Also, in the large opening degree region, the target opening degree TA* is calculated as a value that changes in conjunction with the required load factor KL* (the smoothed value KL*_sm, to be precise). This allows the throttle opening degree TA to be controlled such that the load factor KL is changed to follow changes in the required load factor KL* even in a situation in which gas other than fresh air, such as recirculated exhaust gas, fuel vapor, and blow-by gas, flows into the combustion chamber 11. This improves the controllability of the throttle valve 18 in the large opening degree region.

The above-described embodiment may be modified as follows. The above-described embodiment and the following modifications can be combined as long as the combined modifications remain technically consistent with each other.

In the above-described embodiment, the filtering process F3 is executed to smooth the required load factor KL*, the maximum load factor KLmax, and the switching point load factor KLwot by updating the values to satisfy the relationship of the expression (4). However, the filtering process F3 may be executed by other methods such as a moving average.

In the calculation of the target opening degree TA* in step S210 of the target opening degree calculation routine, at least one of the required load factor KL*, the maximum load factor KLmax, and the switching point load factor KLwot may be used without being changed, that is, without using the smoothed value. The maximum load factor KLmax and the switching point load factor KLwot are included in the denominator term of the second term on the right side of the expression (5), but the required load factor KL* is included only in the numerator term. Thus, the sensitivity of the required load factor KL* to the target opening degree TA* is higher than the sensitivities of the maximum load factor KLmax and the switching point load factor KLwot. Therefore, even in such a case, a smoothed value is preferably used at least for the required load factor KL*. In a case in which the target opening degree TA* is calculated using the required load factor KL*, the maximum load factor KLmax, and the switching point load factor KLwot without changing, the process of step S200 in the target opening degree calculation routine is omitted, and the target opening degree TA* is calculated to satisfy the relationship of the expression (6) in step S210.

$$TA^* = TAwot + (TAmax - TAwot) \times \frac{KL^* - KLwot}{KLmax - KLwot} \tag{6}$$

In the above-described embodiment, the throttle controller is employed in the naturally aspirated engine 10. However, the throttle controller may be employed in a forced-induction engine if the boost pressure is used as the throttle upstream pressure PAC instead of the atmospheric pressure PA.

The engine control unit 22 does not necessarily include an arithmetic processing circuit, which executes various types of calculating process related to engine control, and a memory storing programs and data. For example, at least part of the processes executed by the software in the above-illustrated embodiment may be executed by hardware circuits dedicated to executing these processes (such as ASIC). That is, the engine control unit 22 may be modified as long as it has any one of the following configurations (a) to (c). (a) A configuration including a processor that executes all of the above-described processes according to programs and a program storage device such as a ROM that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A throttle controller that controls an opening degree of a throttle valve installed in an intake passage of an engine, wherein an opening degree of the throttle valve is defined as a throttle opening TA, a target value of the throttle opening degree TA is defined as a target opening degree TA*, a maximum value in a control range of the throttle opening degree TA is defined as a maximum opening degree TAmax, a required value of a load factor KL of the engine is defined as a required load factor KL*, a maximum value of the load factor KL in a current controlled state of the engine is defined as a maximum load factor KLmax, a ratio of an intake pressure after passing through the throttle valve to an intake pressure before passing through the throttle valve is defined as a throttle upstream-downstream pressure ratio RP, the throttle upstream-downstream pressure ratio RP required to cause the load factor KL to be the required load factor KL* is defined as a required pressure ratio RP*, the throttle opening degree TA when the throttle upstream-downstream pressure ratio RP is a specified value RPwot is defined as a switching point opening degree TAwot, the load factor KL when the throttle upstream-downstream pressure ratio RP is the specified value RPwot is defined as a switching point load factor KLwot, the throttle controller is configured to execute a target opening degree calculation process and a throttle actuation process, in the target opening degree calculation process, the throttle controller calculates, as the target opening degree TA*, the throttle opening degree TA at which the throttle upstream-downstream pressure ratio RP is the required pressure ratio RP* in a case in which the value of the required pressure ratio RP* is less than or equal to the specified value RPwot, and calculates, as the target opening degree TA*, a value that satisfies a following expression in a case in which the value of the required pressure ratio RP* exceeds the specified value RPwot, and $$TA^* = TAwot + (TAmax - TAwot) \times \frac{KL^* - KLwot}{KLmax - KLwot}$$

in the throttle actuation process, the throttle controller actuates throttle valve to cause the throttle opening degree TA to be the target opening degree TA*.

2. The throttle controller according to claim 1, wherein the throttle controller uses a smoothed value of the required load factor KL* as a value of the required load factor KL* that is used to calculate the target opening degree TA* in the case in which the value of the required pressure ratio RP* exceeds the specified value RPwot in the target opening degree calculation process.

3. The throttle controller according to claim 2, wherein the throttle controller uses a smoothed value of the switching point load factor KLwot as a value of the switching point load factor KLwot that is used to calculate the target opening degree TA* in the case in which the value of the required pressure ratio RP* exceeds the specified value RPwot in the target opening degree calculation process.

4. The throttle controller according to claim 2, wherein the throttle controller uses a smoothed value of the maximum load factor KLmax as a value of the maximum load factor KLmax that is used to calculate the target opening degree TA* in the case in which the value of the required pressure ratio RP* exceeds the specified value RPwot in the target opening degree calculation process.

5. A throttle controller that controls an opening degree of a throttle valve installed in an intake passage of an engine, wherein an opening degree of the throttle valve is defined as a throttle opening TA, a target value of the throttle opening degree TA is defined as a target opening degree TA*, a maximum value in a control range of the throttle opening degree TA is defined as a maximum opening degree TAmax, a required value of a load factor KL of the engine is defined as a required load factor KL*, a maximum value of the load factor KL in a current controlled state of the engine is defined as a maximum load factor KLmax, a ratio of an intake pressure after passing through the throttle valve to an intake pressure before passing through the throttle valve is defined as a throttle upstream-downstream pressure ratio RP, the throttle upstream-downstream pressure ratio RP required to cause the load factor KL to be the required load factor KL* is defined as a required pressure ratio RP*, the throttle opening degree TA when the throttle upstream-downstream pressure ratio RP is a specified value RPwot is defined as a switching point opening degree TAwot, the load factor KL when the throttle upstream-downstream pressure ratio RP is the specified value RPwot is defined as a switching point load factor KLwot, the throttle controller comprises circuitry that is configured to execute a target opening degree calculation process and a throttle actuation process, in the target opening degree calculation process, the throttle controller calculates, as the target opening degree TA*, the throttle opening degree TA at which the throttle upstream-downstream pressure ratio RP is the required pressure ratio RP* in a case in which the value of the required pressure ratio RP* is less than or equal to the specified value RPwot, and calculates, as the target opening degree TA*, a value that satisfies a following expression in a case in which the value of the required pressure ratio RP* exceeds the specified value RPwot, and $$TA^* = TAwot + (TAmax - TAwot) \times \frac{KL^* - KLwot}{KLmax - KLwot}$$

in the throttle actuation process, the throttle controller actuates throttle valve to cause the throttle opening degree TA to be the target opening degree TA*.

6. A throttle controlling method for controlling an opening degree of a throttle valve installed in an intake passage of an engine, wherein an opening degree of the throttle valve is defined as a throttle opening TA, a target value of the throttle opening degree TA is defined as a target opening degree TA*, a maximum value in a control range of the throttle opening degree TA is defined as a maximum opening degree TAmax, a required value of a load factor KL of the engine is defined as a required load factor KL*, a maximum value of the load factor KL in a current controlled state of the engine is defined as a maximum load factor KLmax, a ratio of an intake pressure after passing through the throttle valve to an intake pressure before passing through the throttle valve is defined as a throttle upstream-downstream pressure ratio RP, the throttle upstream-downstream pressure ratio RP required to cause the load factor KL to be the required load factor KL* is defined as a required pressure ratio RP*, the throttle opening degree TA when the throttle upstream-downstream pressure ratio RP is a specified value RPwot is defined as a switching point opening degree TAwot, the load factor KL when the throttle upstream-downstream pressure ratio RP is the specified value RPwot is defined as a switching point load factor KLwot, the throttle controlling method comprising:

calculating, as the target opening degree TA*, the throttle opening degree TA at which the throttle upstream-downstream pressure ratio RP is the required pressure ratio RP* in a case in which the value of the required pressure ratio RP* is less than or equal to the specified value RPwot;

calculating, as the target opening degree TA*, a value that satisfies a following expression in a case in which the value of the required pressure ratio RP* exceeds the specified value RPwot; and $$TA^* = TAwot + (TAmax - TAwot) \times \frac{KL^* - KLwot}{KLmax - KLwot}$$

actuating throttle valve to cause the throttle opening degree TA to be the target opening degree TA*.

* * * * *